US005638999A

United States Patent [19]

Greene

[11] Patent Number: 5,638,999

[45] Date of Patent: Jun. 17, 1997

[54] DEVICE FOR FORMING A POCKET IN A SPORTS GLOVE, MITT OR SIMILAR ARTICLE

[76] Inventor: Ryan A. Greene, 235 Overlook Dr., Greenwich, Conn. 06830

[21] Appl. No.: 292,231

[22] Filed: Aug. 17, 1994

[51] Int. Cl.[6] ..... A41D 1/00

[52] U.S. Cl. ..... 223/78; 475/437; 475/417

[58] Field of Search ..... 223/78, 79, 80; 273/268, 25; D21/84, 64, 211

[56] References Cited

U.S. PATENT DOCUMENTS

| | | | |
|---|---|---|---|
| D. 196,878 | 11/1963 | McCain | D21/211 X |
| D. 364,653 | 11/1995 | Boden | D21/64 |
| 1,124,896 | 1/1915 | Hartman | 232/4 |
| 1,549,790 | 8/1925 | Nevsella | D21/84 X |
| 3,169,019 | 2/1965 | Genjack | 273/26 |
| 4,454,204 | 6/1984 | Posey | 428/542.4 |
| 4,765,519 | 8/1988 | Groves | 223/78 |
| 4,865,045 | 9/1989 | Monreal | 223/118 |
| 5,000,317 | 3/1991 | Cich | 223/78 |
| 5,265,871 | 11/1993 | Hanley | 273/25 |

*Primary Examiner*—Bibhu Mohanty
*Attorney, Agent, or Firm*—James J. McKeever

[57] ABSTRACT

The present invention relates to the field of sports and more particularly to any sport that involves the use of a ball and glove, mitt or similar article. Specifically, the present invention relates to a device that aids the user in forming the desired pocket in the related glove or mitt over a time period that is dramatically shorter than the presently used methods.

4 Claims, 3 Drawing Sheets

DEVICE FOR FORMING A POCKET IN A SPORTS GLOVE, MITT OR SIMILAR ARTICLE

FIELD OF THE INVENTION

The field of the present invention is sports equipment and specifically sports gloves and/or mitts that are designed and shaped to handle a ball, other sports object or related article.

BACKGROUND OF THE INVENTION

U.S. Pat. No. 4,958,729 issued to R. L. Wright on 25 Sep. 1990, entitled Ball Glove Conditioning Ball, is related to placing a baceball glove in a bag that has straps that hold the glove in a closed position. The bag contains a form liner which, in turn contains conditioning oil. The that is used to shape the pocket contains a conditioning fluid. There is not even the slightest suggestion og the actual ball attached to the handle of the present invention.

U.S. Pat. No. 5,267,677 issued to L. A. Nash on 7 Dec. 1993, entitled Athletic Glove Pocket Former, Shaper and Conditioning Device, is related to a pocket forming device that is a bulbous member, generally in pear shape. Heat is supplied and a conditioning fluid, as in Wright supra., is also supplied and the glove is tied is tied around the ball. Again, there is not even the slightest disclosure of the actual ball and handle of the present invention.

U.S. Pat. No. 5,265,871, issued to W. E. Hanley on 30 Nov. 1993, entitled "Baseball Conditioning Tool and Method," is related to a device for conditioning the pocket in a baseball glove as is the device of the present invention. However, this is the only similarity of the two devices. The Hanley device calls for and discloses a tool for conditioning a baseball glove that requires elbow shaped removable head on the handle and this elbow shaped head has an upper arm and a lower arm to grasp the ball to the removable head. Furthermore, the entire head must be removed and replaced with a head with a different size upper and lower arm arrangement in order to change, for example, changing from a baseball to a softball.

The device of the present invention is much simpler and much less expensive to manufacture and to sell. It has no removable elbowed head and no upper arm and no lower arm to grasp it to an elbowed removable head which the present invention doesn't have in the first place.

It is clearly seen that the present invention is patentably distinguishable from the devise of the Hanley reference and is also obvious that the devise of the present invention is considerably less expensive to manufacture and to sell.

OBJECTS OF THE INVENTION

The object of the present invention is to provide a novel device to aid the user in forming the desired pocket and location in said glove that is used in sports or related activities.

Another object of the present invention is to provide a novel device to aid the user in forming various size pockets in a number of gloves used in a number of different sports or related activity.

A further object of the present invention is to provide a novel device to aid the user in forming various size pockets in gloves used in various sports or related activity, that is completely portable.

A still further object of the present invention is to provide a novel device to aid the user in forming various size pockets in gloves or mitts used in various sports or a related activity, or to soften the very stiff material out of which a glove, etc. is made, that may be used anywhere and in spare time.

Various other objects, advantages and features of the present invention will become apparent to those skilled in the art from the previous and following discussion, taken in conjunction with the accompanying examples and drawings, which constitute a part hereof.

SUMMARY OF THE INVENTION

Sport gloves or mitts are used in many sports to either catch a ball or deflect some other object. Examples of these are baseball, softball, cricket, hockey, as well as a number of other sports. Sports gloves and mitts are generally manufactured and assembled utilizing leather, vinyl or other synthetic composition which requires a softening or "breaking-in" in order to be effective for end use. New and unused materials tend to be very stiff and rigid with limited flexibility of movement.

In these sports, it is necessary to "break-in" leather or modem composition material gloves by forming a desired pocket in said gloves, in order to catch, receive or deflect a fast moving object. This is accomplished presently by the user continuously throwing the ball or whatever other object is involved, into that glove until the desired pocket is formed, or any of the other non-proficient methods. With a baseball for example, this involves a long, tedious and trying process involving many hours and often many weeks. While this is being done, the user incurs many problems, because of the stiffness of the leather and no properly formed pocket, he drops the ball, the ball rolls away and the like. The device of the present invention can reduce this "break-in" period by up to 75%, while creating a more precisely located pocket.

It is to correct these problems that the novel device of the present invention was developed. The device of the present invention comprises a handle and at the other end of the handle is a ball or similar device, for example, a ball like object, a puck or whatever, that is either permanently attached to said handle or is removably attached to said handle.

When the ball, etc. is permanently attached to said handle, the device of the present invention may be used only for that sport that the ball from which said ball is used and as such, is ideally suited to a team, so that all members of that team can form that desired pocket in all of their gloves.

When it is to be used by a sole owner who plays many different sports and has a different glove for each sport, the device of the present invention is available with a removably attached ball, etc. at the end of the handle. When the user wishes to "break-in" a baseball glove and form the desired pocket, he chooses a simulated or real baseball to be attached to the handle. When the user wishes to "break-in" a softball, he attaches a simulated or real softball to his handle. In choosing a simulated or real ball, it is preferable to use the simulated ball because it can be weighted and, as such, will be heavier and form the desired pocket in a shorter period of time.

The device of the present invention is ambidextrous and may be used with either the right or left hand. In practice, the user will put the new glove on glove hand and uses the device of the present invention in the other hand.

With the motion of a person using a hatchet, the user continuously and repeatedly hits the glove in the position at which he wishes to form the desired pocket. This process is continued until the desired pocket is formed in the user's gloves or the material is softened enough.

The device of the present invention is comprised generally of two pieces, a handle, of any desired length, generally from about 250 mm to about 500 mm and the ball, etc. of the related sport. The material out of which the handle is made is not critical nor is the ball material critical. The materials out of which these two pieces or in the case of a one piece device may be made may be selected from the group consisting of metal, plastic, hard rubber, wood and composition material. The device of the present invention may be all one material or may be made in combination.

DESCRIPTION OF THE PREFERRED EMBODIMENT OF THE PRESENT INVENTION

It should be noted that in the following discussions the use of the term ball shall include any type of sports missile in which a sports glove may be used and the use of the term glove will include any glove, mitt or similar article that may be used in connection with the sports ball as described above.

Figure 1:
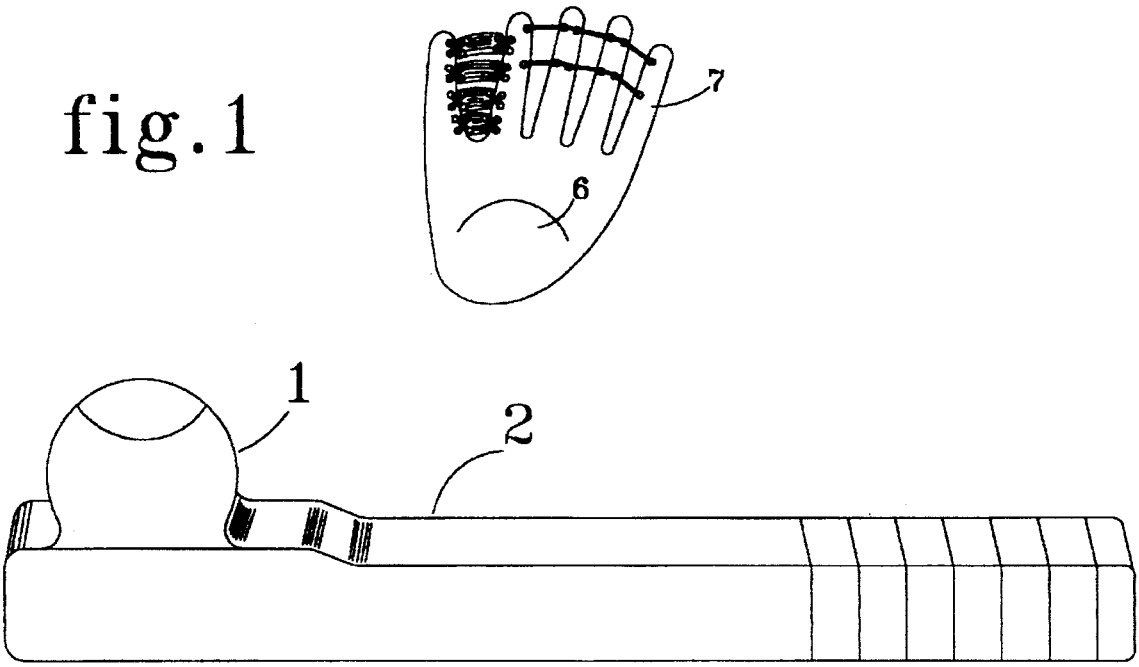
FIG. 1 is a perspective view of the device of the present invention showing a one piece molded unit.

The device of the present invention is shown in a perspective view in FIG. 1 in the one piece molded mode, with the ball at 1 and the handle at 2. When a user wishes to form a pocket in a glove 7, mitt or similar article, he takes the device of the present invention by the handle 2 and repeatedly strikes the glove 7, etc., with the ball 1 end of the handle 2 in that area of the glove 7 at which the pocket 6 is to be formed or the areas the user wishes to soften.

Figure 2:
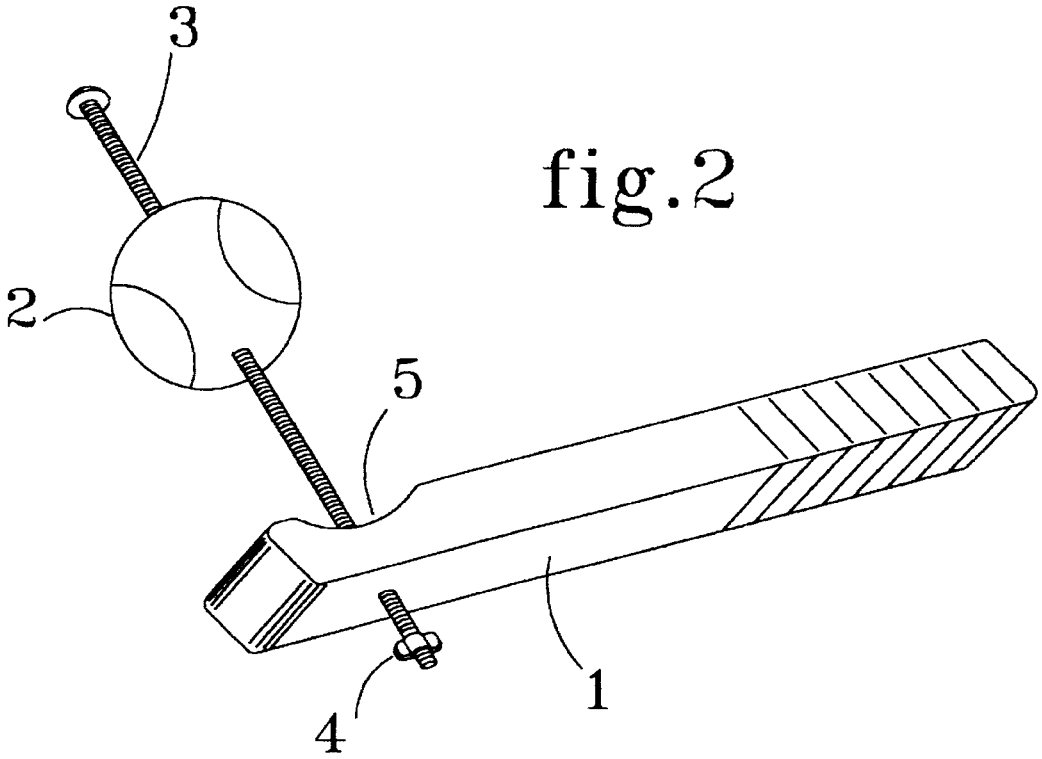
FIG. 2 is a perspective view of the device of the present invention showing a broken view of a unit with a removably attached ball.

An alternative configuration of the device of the present invention is shown in FIG. 2 in which the handle is at 2, the ball, which is in this case removable, is at 1. A removable screw, bolt or any other removable attaching means is at 3. This configuration allows the user to interchange the ball 1 with any related type of sports missile, depending on the sport to be played. The user loosens the fastening nut or whatever attaching means is used 4, to the point that said ball 1 is able to be removed and the new size or type of ball is attached and tightened up to seat in the slight recession 5 in handle 2. The new size pocket former or softener is now ready for use.

Figure 3:
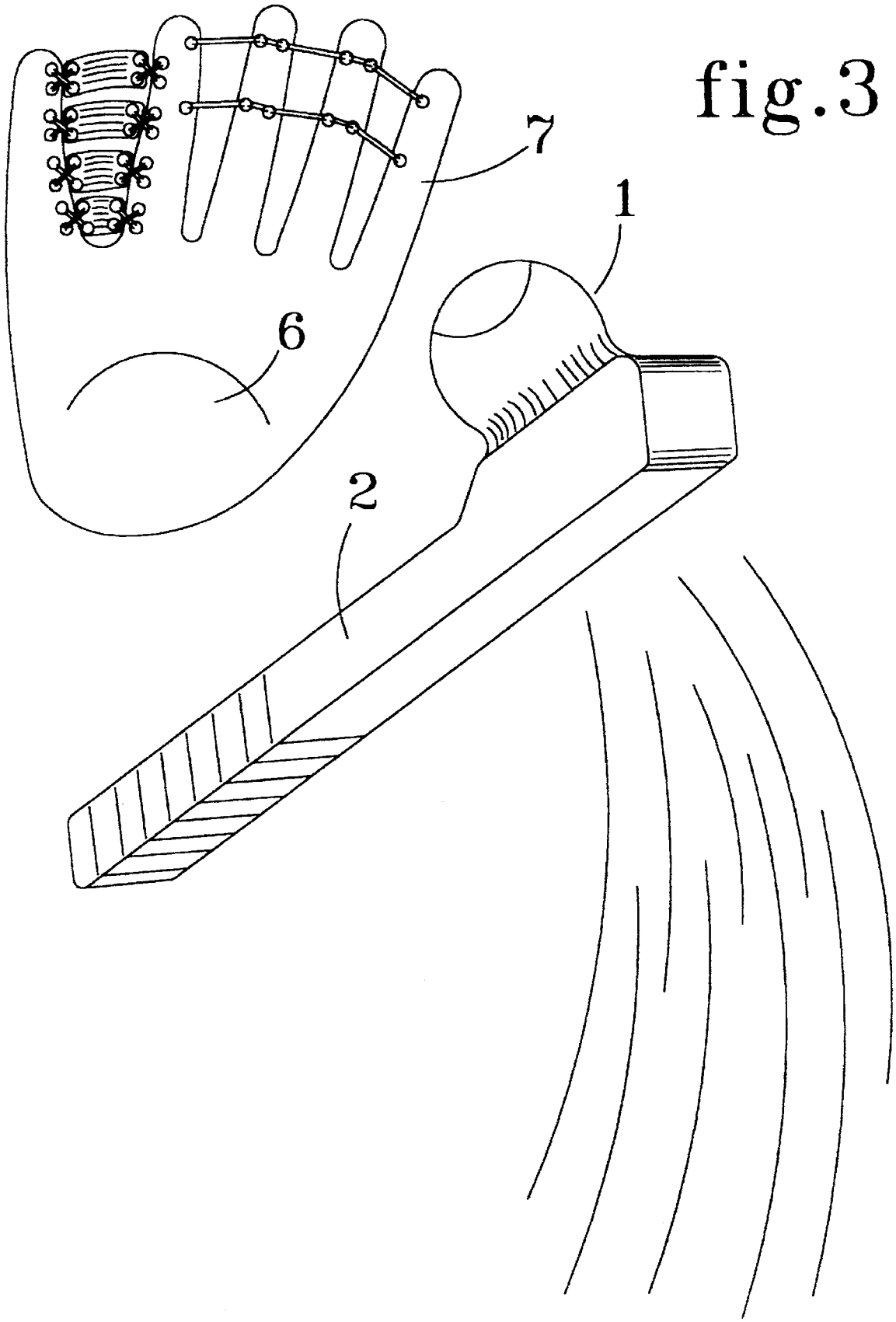
FIG. 3 is a perspective view of the device of the present invention showing a pocket being formed with said device.
Figure 4:
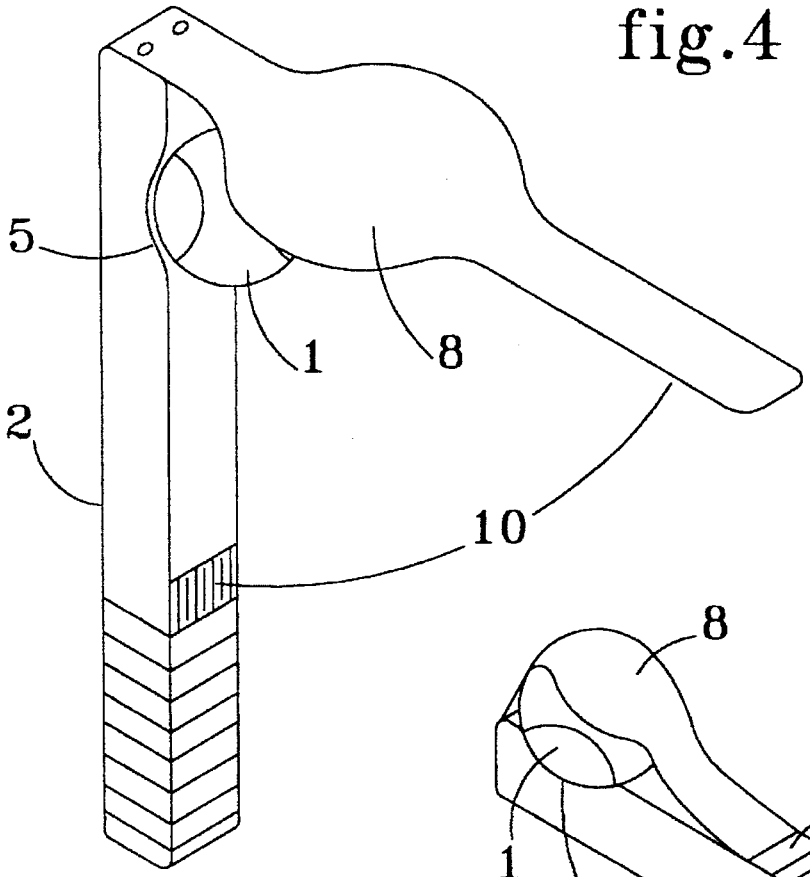
FIG. 4 is a perspective view of the device of the present invention in alternative mode showing a replaceable ball in the open position.
Figure 5:
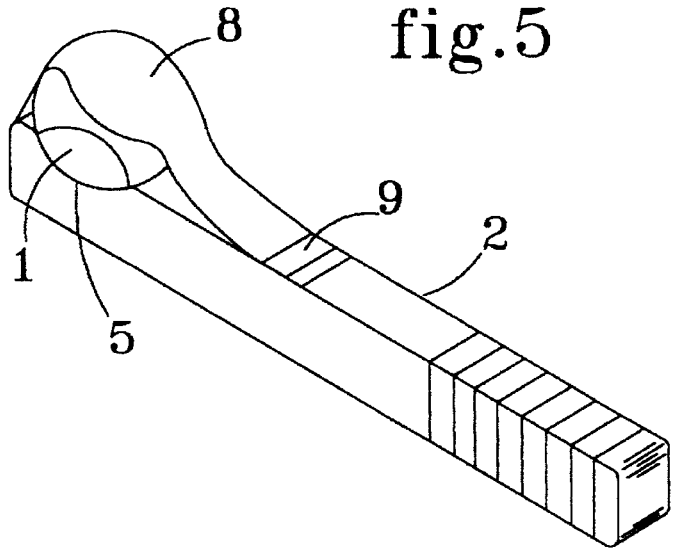
FIG. 5 is a perspective view of the device of the present invention in FIG. 4 but in the closed or useable position.

FIG. 3 shows the device of the present invention in action, shaping a pocket 6 in a glove 7. As the device of the present invention is swung toward the glove 7, the ball 1 on handle 2 strikes glove 7 in the pocket area 6. This is done repeatedly until the desired pocket 6 is formed FIGS. 4 and 5 show an additional configuration of the device of the present invention that allows another method of changing the type of ball 1 that is to be used with handle 2. Said ball 1 is placed in recess 5 and retaining strap 8 holds ball 1 in place. The handle is fitted with attaching means 9, said attaching means may be of any desired kind such as screws, rivets, nails or even Velcro®, etc. and the other end of retaining strap 8 and handle 2 is fitted with securing means 10 of whatever type or kind that is desired such as, a buckle, snaps, Velcro®, etc. The selection of attaching means 9 and securing means 10 is not important, as long as, the ball is held securely in recess 5 on handle 2. The same can be said for retaining strap 8, it can be of leather, plastic or whatever. The user releases securing means 10 and removes the ball 1 that is in recess 5 on handle 2 and replaces it with a different ball 1 and secures it in recess 5 with retaining strap 8 and securing means 10.

While the above description contains many specificities, the reader should not construe these as limitations on the scope of the invention, but merely as exemplification of a preferred embodiment. Those skilled in the art will envision that many other possible variations are within the scope of the present invention. For example, skilled artisans will readily be able to change the dimentions and the materials of the various embodiments. They can make variations on the design of the present invention. Accordingly, the reader is requested to determine the scope of the present invention by the scope of the appended claims and the legal equivalents, and not by the examples given.

What is claimed is:

1. A device for forming a pocket in a sports glove comprising a longitudinal handle and at the other end of said handle, a spherical piece selected from the group consisting of a piece in the shape and size of a baseball, a softball, and a cricket ball, said spherical piece having it's centroid off-set from the longitudinal axis of said handle and molded directly to said handle, thereby being free of any coupling means and spacing arms said spherical piece and said longitudinal handle being molded into one piece.

2. The device of claim 1 wherein said handle of said device is constructed of materials selected from the group consisting of plastic or metal composition.

3. The device of claim 1, wherein said spherical piece of said device is constructed of material selected from the group consisting of plastic or metal composition.

4. A device for forming a pocket and softening other surface areas of a sports glove comprising a longitudinal handle, said handle constructed from materials selected from the group consisting of metal or plastic composition, and a a spherical piece connected to one end of said handle, said spherical piece selected from the group consisting of a piece in the shape and size of a baseball, a softball, and a cricket ball, said spherical piece having it's centroid off-set from the longitudinal axis of said handle and molded directly to said handle, thereby being free of any coupling means and spacing arms and constructed of material selected from the group consisting of metal or plastic composition, said spherical piece and said handle molded into one piece.

* * * * *